US005083494A

United States Patent [19]

Dautremay

[11] Patent Number: 5,083,494

[45] Date of Patent: Jan. 28, 1992

[54] ELECTRO-HYDRAULIC ACTUATOR WITH MECHANICAL MEMORY

[75] Inventor: Gerard Dautremay, Grenoble, France

[73] Assignee: Societe "NEYRPIC", Grenoble, France

[21] Appl. No.: 645,396

[22] Filed: Jan. 24, 1991

[30] Foreign Application Priority Data

Jan. 26, 1990 [FR] France ..... 90 01169

[51] Int. Cl.[5] ..... F15B 13/16

[52] U.S. Cl. ..... 91/361; 91/459; 137/625.64

[58] Field of Search ..... 91/361, 363 R, 363 A, 91/459; 137/625.64, 625.29; 251/259

[56] References Cited

U.S. PATENT DOCUMENTS 2,234,326 3/1941 Tiebel ..... 91/363 R
2,945,477 7/1960 Hadekel ..... 91/363 R
3,018,988 1/1962 Ernst et al. ..... 91/363 R
4,075,930 2/1978 Millett ..... 91/361

FOREIGN PATENT DOCUMENTS 596229 4/1960 Canada ..... 91/363 R

*Primary Examiner*—Edward K. Look
*Assistant Examiner*—Hoang Nguyen
*Attorney, Agent, or Firm*—Dowell & Dowell

[57] ABSTRACT

The reproducing system 9, 10, 42, 43 controls rotation of the rotor 30 of the electric motor 28 in order to provoke a variation in the leakage of the leakage relay 33 with a view to varying the position of the piston 2 of the jack 1. The stator 34 of the motor 28 is connected by a mechanical link 36 to the piston rod 2*a* of the jack 1. In the event of no-voltage, the brake 29 of the motor acts in order to connect the rotor 30 and the stator 34. The position of the rod 2*a* may then be varied by mechanically rotating the rotor-stator assembly 30–34 by a crank 41.

2 Claims, 2 Drawing Sheets

ELECTRO-HYDRAULIC ACTUATOR WITH MECHANICAL MEMORY

BACKGROUND OF THE INVENTION

1. Field of the Invention

Electrohydraulic actuators are generally constituted by a servo-valve, i.e. a hydraulic slide valve with electrically controlled slide.

2. History of the Related Art

Such actuators are in particular intended for controlling a hydraulic single- or double-acting jack and are provided to cause any mechanism to operate in reciprocating motion. The actuators are often equipped with an adjustable mechanical device defining a direction of action of the actuator-jack assembly upon the disappearance of the control voltage of the electrical element for controlling the actuator.

In that case, i.e. when the lack of current brings about a defective servo-control, three possibilities offer themselves:

tendency to open;

tendency to close;

zero tendency, i.e. the actuator and its jack remain in the same position.

Taking into account the drifts, the latter state is not conserved in time, the tendency becomes virtually random, which is incompatible in certain applications such as the regulation of the speed of hydraulic turbines. It is generally necessary in that case, on the one hand, to memorize and conserve the position of the electro-hydraulically controlled jack in the event of breakdown of electrical energy and, on the other hand, to be able to control manually the position of the jack without electrical energy.

Solutions for solving this problem have already been proposed, but they result in complicated, therefore expensive assemblies which are of reduced reliability.

SUMMARY OF THE INVENTION

The improvements forming the subject matter of the present invention aim at making it possible to produce an electro-hydraulic actuator adapted to allow memorization of the position of the member voltage and to include a mechanical manual control of the position of the jack in the event of defective power supply, and the actuator being of simple and economical production.

BRIEF DESCRIPTION OF THE DRAWINGS

The accompanying drawings, given by way of example, will enable the invention, the characteristics that it presents and the advantages that it is capable of procuring, to be more readily understood.

DESCRIPTION OF THE PREFERRED EMBODIMENT

Figure 1:
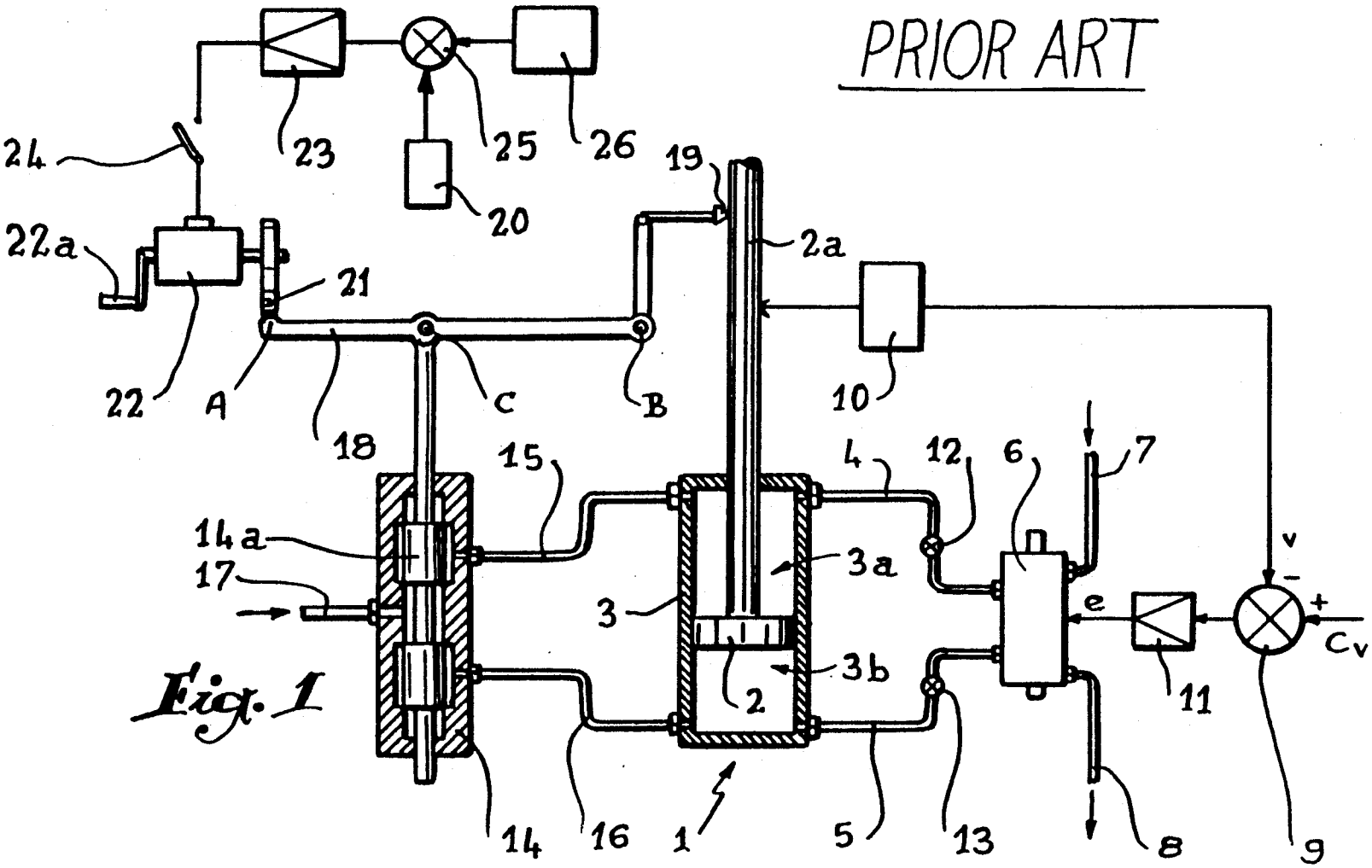
FIG. 1 is a schematic view of a known system comprising the grouping of two reproducing systems.

The actuator according to the invention is intended for supplying a double-acting jack 1 of which the rod 2*a* of the piston 2 is connected to a member (not shown) which may for example be the control of the valve regulation of a hydraulic turbine.

The two chambers 3*a*, 3*b* of the cylinder 3 are each connected by means of a pipes 4, 5 to a conventional slide valve 6 provided with an electrical control of displacement (not shown). In conventional manner, two other pipes 7 and 8 supply and evacuate, respectively, fluid under pressure to and from the slide valve 6. In known manner, a comparator 9 receives an electrical reference of position Cv as well as an electrical signal v coming from a sensor 10 of the position of the rod 2*a*. The difference between the reference. Cv and the signal v elaborated by the comparator 9 is processed by an electrical amplifier 11 which supplies an electrical signal or deviation e to the electro-hydraulic slide valve 6.

It is observed that electro stop valves 12 and 13 are respectively inserted in the pipes 4 and 5 for reasons which will be explained hereinbelow.

The functioning of such an electro-hydraulic reproducing system, which is well known, will not be described here.

When it is desired to memorize the position of the rod 2*a* of the piston 2 of the jack 1 in the event of defective electric current, a second electro-mechanical reproducing system shown on the left-hand side of FIG. 1 is used.

This reproducing system comprises a slide valve 14 supplying by two pipes 15 and 16 the two chambers 3*a*, 3*b* of the cylinder 3 from the pressurized fluid supplied to the slide valve 14 by a pipe 17. The slide 14*a* of the slide valve 14 is articulated on a floating lever 18 at a point C. One of the ends B of the lever 18 is connected to a position indicator 19 associated with a position sensor 20 similar to 10. The other end A of the lever 18 is associated with a cam 21 fitted on the driven shaft of a gear motor 22. The motor 22 is supplied by the output of an amplifier 23 via a switch 24. A comparator 25 produces an electric signal controlled by the difference between a reference 26 and the value given by the sensor 20, said signal being amplified by the apparatus 23.

Operation is as follows:

In automatic mode, the jack 1 is under the control of the electro-hydraulic reproducing system associated with the slide valve 6, while the slide 14*a* of the slide valve 14 is maintained in central closed position, as illustrated in the Figure, thanks to the reproducing system controlling the gear motor 22.

In the event of lack of current, the valves 12 and 13 are closed so as to conserve the position of the piston rod 2*a*, while the switch 24 is open.

If it is desired to modify the position of the rod 2*a* of the jack, it suffices to act on a crank 22*a* associated with the gear motor 22 in order mechanically to displace the slide 14*a* of the slide valve 14.

When the current returns, it provokes opening of the valves 12 and 13 and closure of the switch 24, with the result that the position of the rod 2*a* of the piston 2 of the jack is again servo-controlled by the reproducing system associated with the slide valve 6.

The foregoing description shows the complexity of the system which results in high cost and reduced reliability. Moreover, it is necessary to provide an open loop adapted to maintain the slide 14*a* of the slide valve 14 in central closed position during automatic operation in order to avoid the transfers of fluid between the slide valves 6 and 14.

Figure 2:
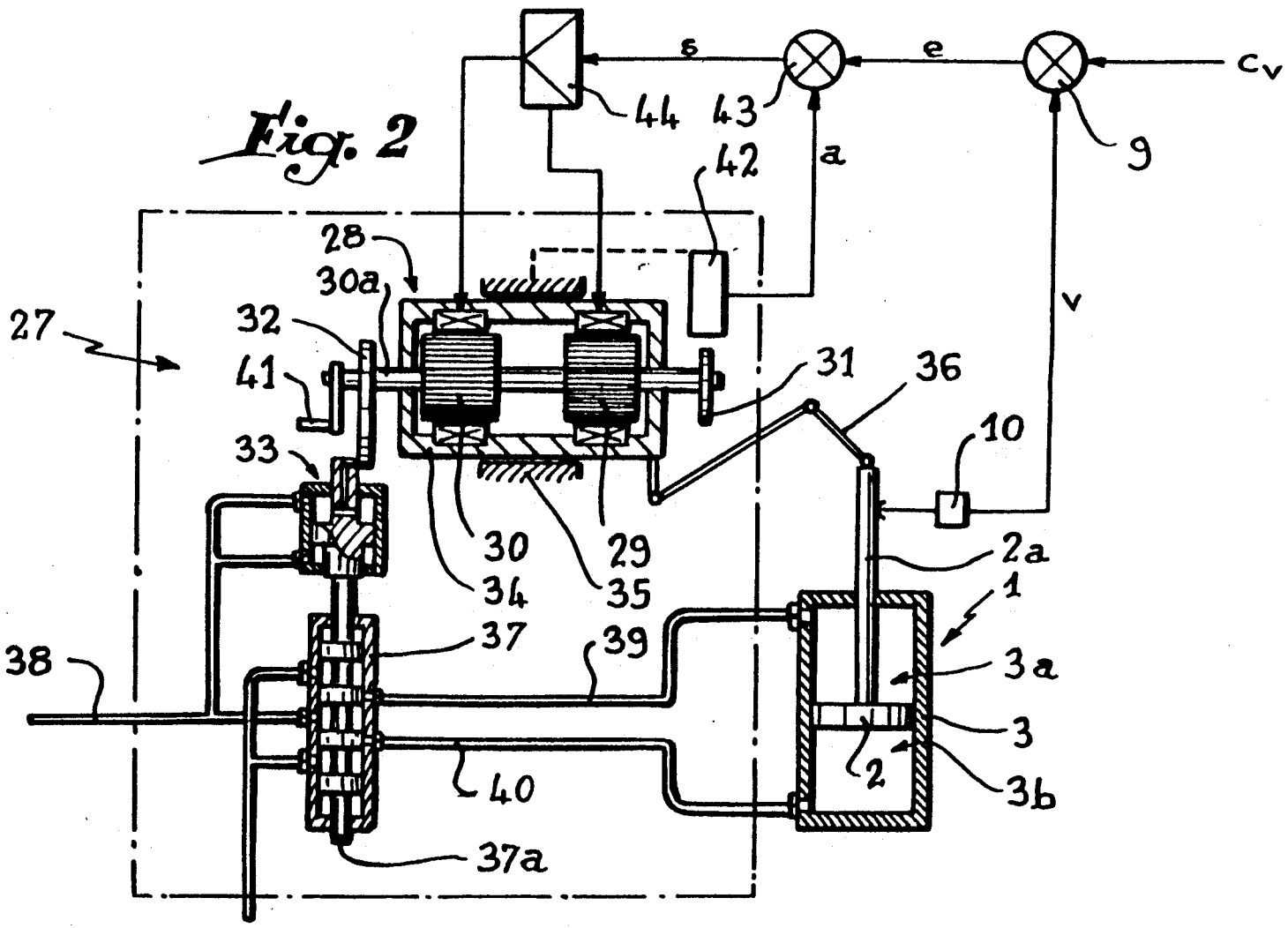
FIG. 2 is a diagram of the actuator according to the invention.

FIG. 2 illustrates a hydraulic actuator 27 according to the invention and intended for controlling the jack 1. The comparator 9 receiving the reference Cv as well as the sensor 10 noting the position of the rod 2*a* of the piston 2 of the jack 1 and emitting the electric signal v, are the same as FIG. 1.

The actuator 27 essentially comprises an A.C. motor 28 equipped with a brake 29 operating in response to no-voltage. The rotor 30 of the motor comprises a shaft 30*a* on the two ends of which are fitted, on the one hand, a servo-control cam 31 and, on the other hand, a cam 32 for controlling a leakage relay 33. The stator 34 of the motor 28 is mounted to rotate in bearings 35. This stator is connected by a mechanical link 36 to the rod 2*a* of the piston 2 of the jack 1.

The leakage relay 33 is associated with the slide 37*a* of a slide valve 37 conducting pressurized fluid coming from an appropriate source via a pipe 38 towards the two chambers 3*a*, 3*b* of the cylinder 3 by two pipes 39 and 40.

A crank 41 is also fitted on the shaft 30*a* of the rotor 30 or motor 28. A sensor 42 mounted on one of the bearings 35 notes the angular position of the cam 31 and conducts the corresponding signal a to a second comparator 43 which also receives the deviation signal e coming from the comparator 9 and corresponding to the difference between the reference Cv and the electric signal v coming from the sensor 10. The signal s issuing from the comparator 43 is sent into an amplifier 44 emitting electric current to rotate the rotor 30 of the motor 28.

Operation is as follows: In automatic mode, the signal e emitted by the comparator 9 given by the electrical servo-control constitutes the reference of angular position of the rotor 30 of the motor 28 to determine the position of the slide 37*a* of the slide valve 37 via the cam 32 and the leakage relay 33.

Any movement of the jack 1 imposed by the actuator obviously brings about a subsequent rotation of the stator 34, of the motor 28, due to the mechanical link 36. However, this movement of the stator is inoperative as its angular speed is very low compared to that of the rotor and in addition the sensor 42 of angular servo-control of the rotor 30 is fixed in space since it is secured to one of the bearings 35. Rotation of the rotor 30 rotates the cam 32 for controlling the leakage relay 33, with the result that as the position of the relay changes, it brings about a variation in the position of the slide 37*a* of the slide valve 37 so as to control an appropriate displacement of the piston 2 of the jack 1.

When there is a lack of current, pipe 38 is still supplied with pressurized fluid, the brake 29 is blocked, with the result that the rotor 30 and the stator 34 become fixed with respect to one another. The rod 2*a* of the piston 2 is thus blocked in the position that it occupied at the moment of no-voltage.

If a variation of the position of the rod 2*a* of the piston 2 is necessary, the crank 41 is actuated to provoke an appropriate variation of the leakage of the relay 33. Consequently, a displacement of the slide 37*a* of the slide valve 37 occurs, as well as a supply of pressurized fluid of cylinder 3.

It must, moreover, be understood that the foregoing description has been given only by way of example and that it in no way limits the domain of the invention which would not be exceeded by replacing the details of execution described by any other equivalents.

What is claimed is:

1. An electro-hydraulic actuator for controlling a jack means having a piston movable within a cylinder, the actuator being of the type for memorizing and conserving the position of the piston of the jack means and for manually controlling the position of the piston within the jack means, the supply of the jack means with pressurized fluid being effected by way of the actuator, characterized in that the actuator comprises:

a motor having a rotor and a stator, said motor having a brake which is operable when no voltage is supplied to the motor, said stator being rotatable with respect to fixed bearings;

first and second cam means rotatably mounted to said rotor;

a leakage relay including valve means for supplying the jack means with pressurized fluid, said valve means including means for bleeding said pressurized fluid from said valve means, said first cam means being positioned to control said means for bleeding said pressurized fluid from said valve means;

a first sensor means for indicating the angular position of said second cam means;

a mechanical link between said stator and said piston of said jack means for controlling the movement of said piston;

an electrical link conducting a signal emitted by said first sensor means to a comparator which emits a signal for controlling the rotation of said rotor of said motor;

and manual means for selectively rotating said rotor and said stator of said motor to thereby modify the position of said piston during absence of electrical supply.

2. The actuator of claim 1 in which said comparator emits a signal corresponding to the difference between the deviation of a reference signal and a signal generated by a second sensor which monitors the position of said piston and the signal generated by said first sensor means.

* * * * *